US009435348B2

(12) United States Patent
Wu

(10) Patent No.: US 9,435,348 B2
(45) Date of Patent: Sep. 6, 2016

(54) FAN STRUCTURE

(75) Inventor: Chun-Ming Wu, New Taipei (TW)

(73) Assignee: Asia Vital Components Co., Ltd., New Taipei (TW)

( * ) Notice: Subject to any disclaimer, the term of this patent is extended or adjusted under 35 U.S.C. 154(b) by 684 days.

(21) Appl. No.: 13/545,007

(22) Filed: Jul. 10, 2012

(65) Prior Publication Data

US 2014/0017075 A1 Jan. 16, 2014

(51) Int. Cl.

*F04D 29/056* (2006.01)
*F04D 29/62* (2006.01)
*F04D 25/06* (2006.01)

(52) U.S. Cl.

CPC ..... *F04D 29/056* (2013.01); *F04D 25/0646* (2013.01); *F04D 29/626* (2013.01)

(58) Field of Classification Search

CPC .... F04D 29/42; F04D 29/046; F04D 29/056; F04D 29/058; F04D 29/281; F04D 29/282; F04D 17/105; F04D 29/04; F04D 29/0462; F04D 29/0465; F04D 29/0563; F04D 29/0566; F04D 29/057; F04D 29/28; F04D 25/0613; F04D 25/062; F04D 25/0646

USPC ..... 417/423.12; 416/194–196 R

See application file for complete search history.

(56) References Cited

U.S. PATENT DOCUMENTS

| | | | | |
|---|---|---|---|---|
| 5,982,064 | A * | 11/1999 | Umeda et al. | 310/90 |
| 6,270,325 | B1 * | 8/2001 | Hsieh | 417/423.12 |
| 6,612,814 | B2 * | 9/2003 | Shih et al. | 417/354 |
| 6,726,450 | B2 * | 4/2004 | Lee et al. | 415/230 |
| 6,776,576 | B2 * | 8/2004 | Lee | 415/206 |
| 7,476,076 | B2 * | 1/2009 | Shimada | 415/58.4 |
| 2005/0201864 | A1 * | 9/2005 | Yoshida et al. | 416/206 |
| 2010/0329901 | A1 * | 12/2010 | Horng | 417/354 |

* cited by examiner

*Primary Examiner* — Devon Kramer
*Assistant Examiner* — Charles Nichols
(74) *Attorney, Agent, or Firm* — C. G. Mersereau; Nikolai & Mersereau, P.A.

(57) ABSTRACT

A fan structure includes an upper cover, a fan frame body, a bearing cup, a bearing, a stator assembly, a hub and a shaft rod. The upper cover is mated with the fan frame body to together define a receiving space in which the bearing cup is disposed. The bearing cup has an open end and a closed end. The bearing is disposed in the bearing cup. The stator assembly is fitted around the bearing cup. The hub has multiple outward extending blades spaced from the upper cover by a first distance. The shaft rod has a connection end connected with the hub and a protruding end passing through the shaft hole and protruding from the bearing to abut against the closed end of the bearing cup and define a second distance. The first distance is smaller than the second distance to avoid deflection of the shaft rod.

4 Claims, 6 Drawing Sheets

FAN STRUCTURE

BACKGROUND OF THE INVENTION

1. Field of the Invention

The present invention relates to a fan structure in which the shaft rod is prevented from being deflected during the assembling or transfer process of the fan so that the shaft rod will not be stuck with the bearing.

2. Description of the Related Art

A conventional thermal module is generally composed of multiple heat dissipation units assembled with each other, including heat sink, heat pipe and cooling fan. In heat dissipation process, the heat sink can increase the heat dissipation area and the heat pipe can increase the heat transfer efficiency. As the electronic device operates at higher and higher speed, the electronic components inside the electronic device for operation work generate high heat. In the case that the heat still cannot be efficiently dissipated by means of both the heat sink and the heat pipe, it is necessary to use a cooling fan to forcedly dissipate the heat so as to lower the temperature of the electronic components and avoid burnout of the electronic components due to overheating.

The cooling fan is composed of a frame body, a rotor and a stator. A bearing cup perpendicularly extends from the frame body. A bearing is disposed in the bearing cup. The rotor includes a hub and a shaft rod. The hub has multiple blades outward extending from the hub. One end of the shaft rod is connected with the hub, while the other end of the shaft rod is rotatably connected with bearing. The stator includes multiple stacked silicon steel sheets and multiple windings wound around the silicon steel sheets. The bearing and the shaft rod are rotatably assembled with each other in a loose fit manner. In operation of the cooling fan, the shaft rod is rotated relative to the bearing. A small gap exists between the shaft rod and the bearing. In general, a lubricant is filled in the gap to reduce frictional wear between the shaft rod and the bearing. Due to the gap, during the transfer or assembling process of the cooling fan, the shaft rod is likely to deflect due to vibration. As a result, the blades tend to be stuck with the frame body and the shaft rod tends to be stuck with the bearing. Under such circumstance, the cooling will damage and fail.

SUMMARY OF THE INVENTION

It is therefore a primary object of the present invention to provide a fan structure in which the shaft rod is prevented from being deflected due to vibration during the transfer or assembling process of the cooling fan. Therefore, the blades will not be stuck with the frame body and the shaft rod will not be stuck with the bearing.

To achieve the above and other objects, the fan structure of the present invention includes an upper cover, a fan frame body, a bearing cup, a bearing, a stator assembly, a hub and a shaft rod.

The upper cover has a first opening. The upper cover is correspondingly mated with the fan frame body to together define a receiving space. A wind outlet is formed on one side of the fan frame body. The bearing cup is selectively formed on the upper cover or the fan frame body and protrudes from the upper cover or the fan frame body. An extension section perpendicularly extends from a periphery of a bottom wall of the fan frame body. The wind outlet is formed on one side of the extension section. The upper cover is correspondingly mated with the extension section. The bearing is disposed in the bearing cup. The bearing has a first end, a second end and a shaft hole. The shaft hole passes through the bearing in communication with the first and second ends. The stator assembly is fitted around the bearing cup. The hub has multiple blades outward extending from the hub. Each blade has a first side and a second side. The first side is spaced from the upper cover by a first distance. The shaft rod has a connection end and a protruding end. The connection end is connected with the hub. The protruding end passes through the shaft hole and protrudes from the second end of the bearing to abut against the closed end of the bearing cup and define a second distance. The first distance is smaller than the second distance.

The first distance is set to be smaller than the second distance. In this case, during the transfer or assembling process of the cooling fan, the shaft rod is prevented from being deflected due to vibration. Therefore, the blades will not be stuck with the frame body and the shaft rod will not be stuck with the bearing.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
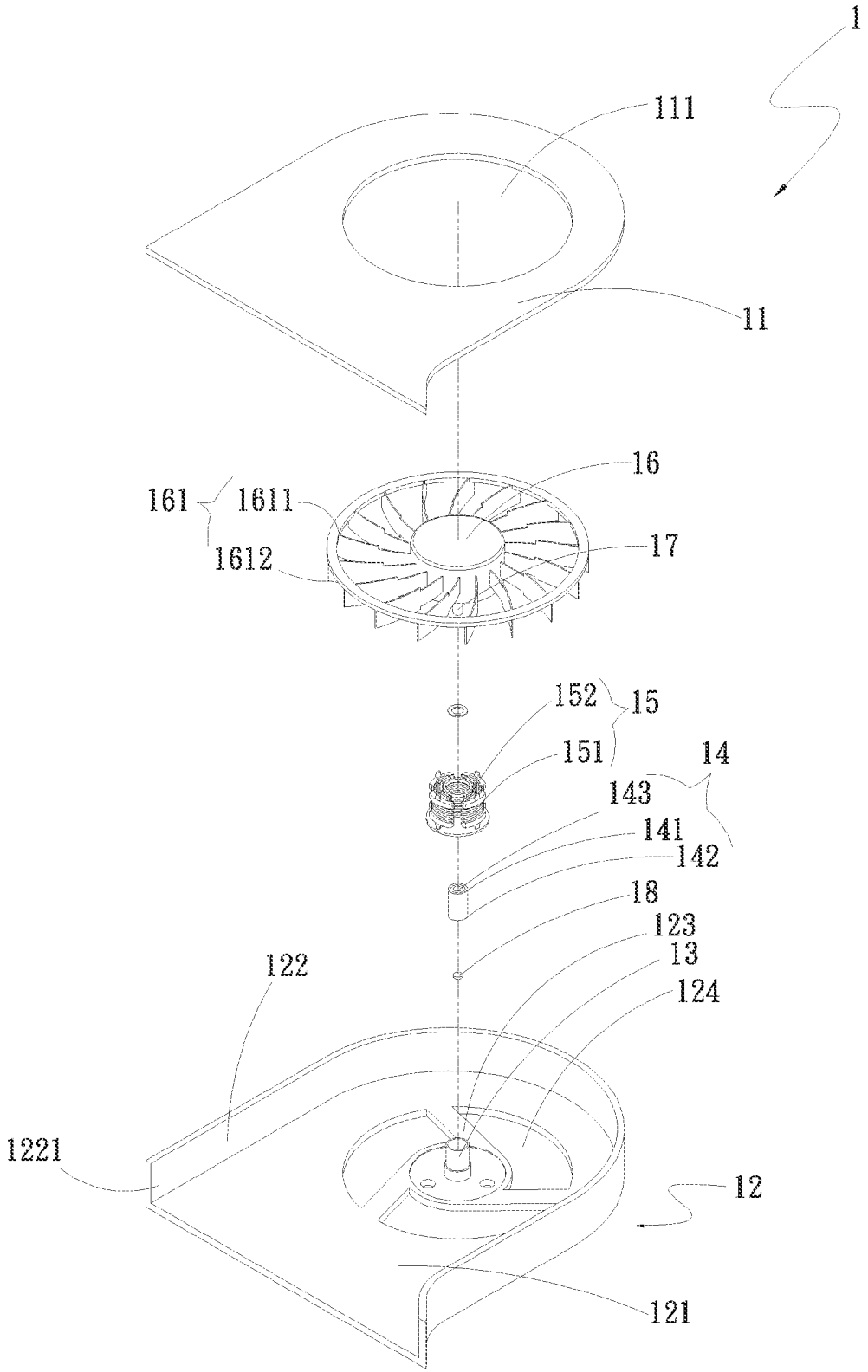
FIG. 1 is a perspective exploded view of a first embodiment of the fan structure of the present invention.
Figure 2:
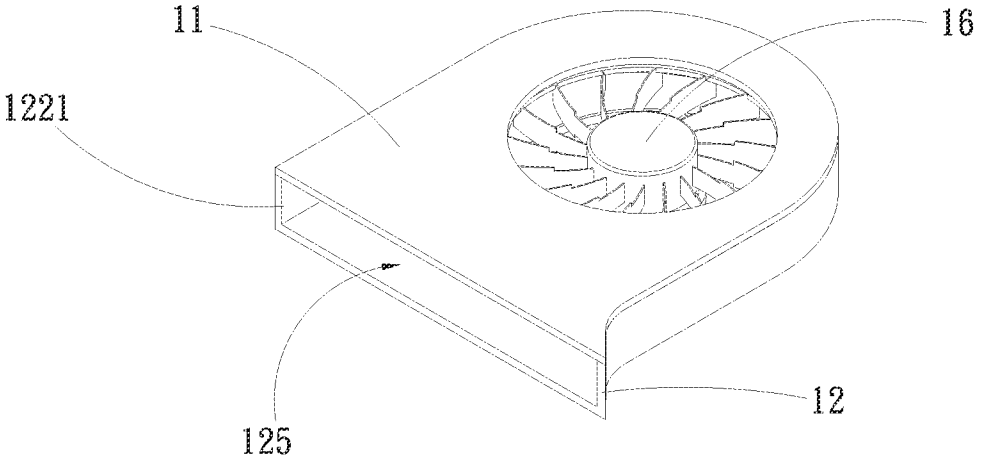
FIG. 2 is a perspective assembled view of the first embodiment of the fan structure of the present invention.
Figure 3:
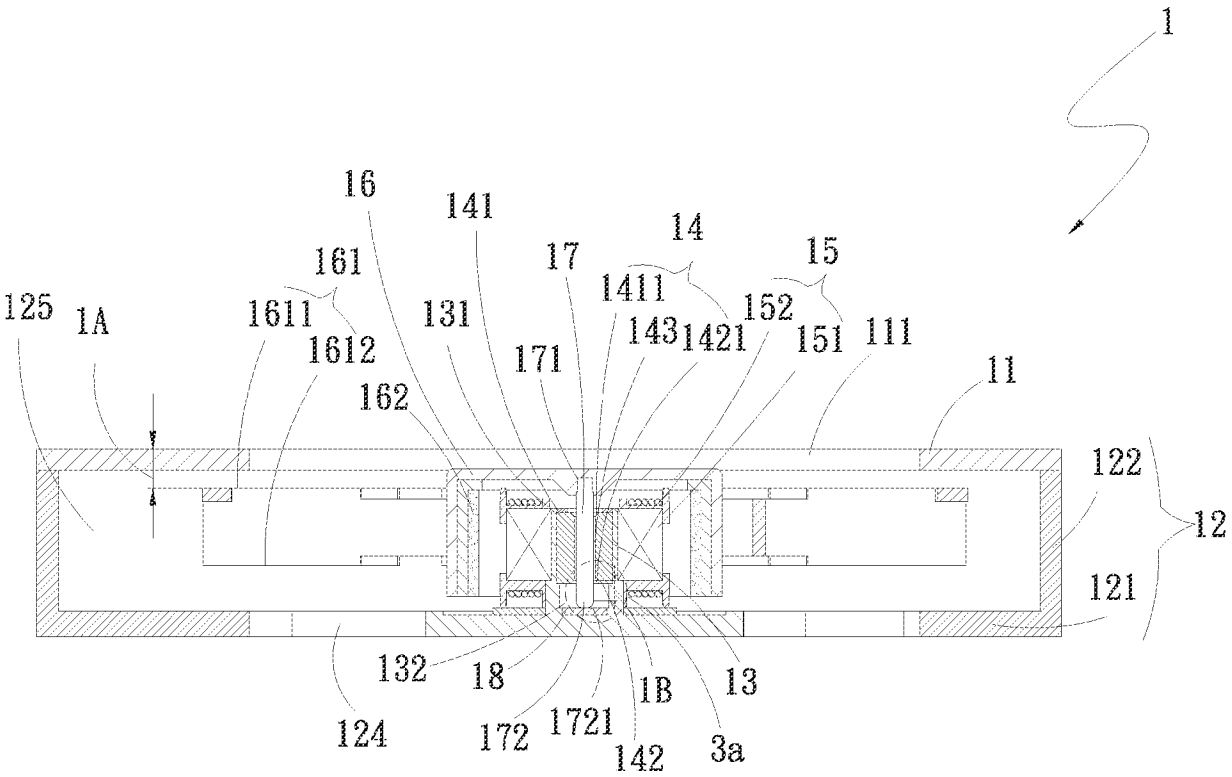
FIG. 3 is a sectional assembled view of the first embodiment of the fan structure of the present invention.
Figure 3A:
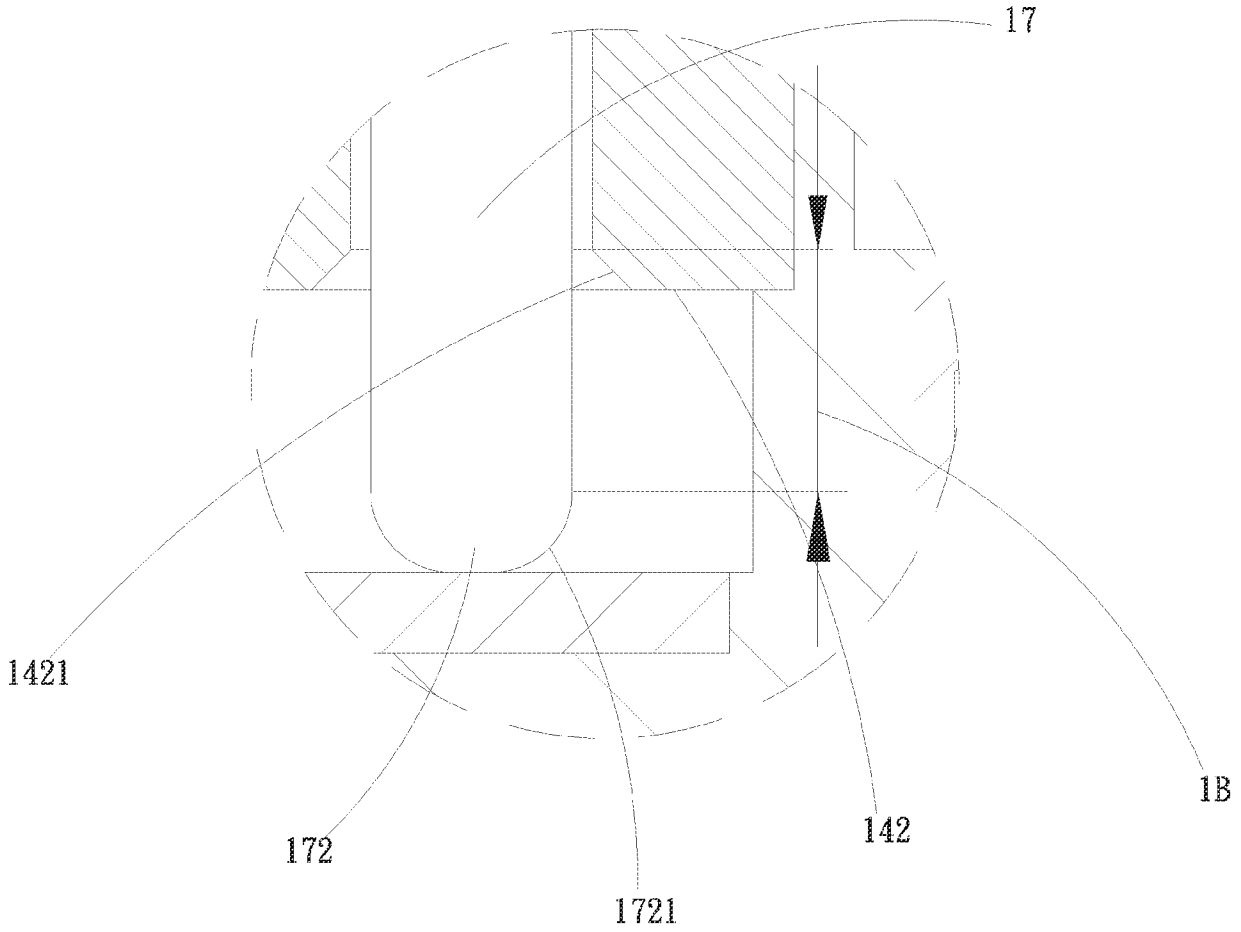
FIG. 3*a* is an enlarged sectional assembled view of a part of the first embodiment of the fan structure of the present invention.

Please refer to FIGS. 1, 2, 3 and 3*a*. FIG. 1 is a perspective exploded view of a first embodiment of the fan structure of the present invention. FIG. 2 is a perspective assembled view of the first embodiment of the fan structure of the present invention. FIG. 3 is a sectional assembled view of the first embodiment of the fan structure of the present invention. FIG. 3*a* is an enlarged sectional assembled view of a part of the first embodiment of the fan structure of the present invention. According to the first embodiment, the fan structure 1 of the present invention includes an upper cover 11, a fan frame body 12, a bearing cup 13, a bearing 14, a stator assembly 15, a hub 16 and a shaft rod 17.

The upper cover 11 has a first opening 111. The fan frame body 12 has a bottom wall 121. An extension section 122 perpendicularly extends from a periphery of the bottom wall 121 to define a wind outlet 1221. The bottom wall further has multiple ribs 123. The wind outlet 1221 is formed on one side of the extension section 122. Two ends of the ribs 123 are respectively connected to the bearing cup 13 and the bottom wall 121 to together define multiple second openings 124. The upper cover 11 is correspondingly mated with the extension section 122 of the fan frame body 12 to together define a receiving space 125.

The bearing cup 13 is selectively formed on the upper cover 11 or the fan frame body 12 and protrudes from the upper cover 11 or the fan frame body 12. The bearing cup 13 has an open end 131 and a closed end 132. In this embodiment, the bearing cup 13 extends from the bottom wall 121 of the fan frame body 12 toward the upper cover 11. A wear plate 18 is disposed at the closed end 132 of the bearing cup 13.

The bearing 14 is disposed in the bearing cup 13. The bearing 14 has a first end 141, a second end 142 and a shaft hole 143. The shaft hole 143 passes through the bearing 14 in communication with the first and second ends 141, 142. The stator assembly 15 is fitted around the bearing cup 13.

The stator assembly 15 has multiple silicon steel sheets 151 and multiple windings 152 wound around the silicon steel sheets 151.

The hub 16 has multiple blades 161 outward extending from the hub 16. Each blade 161 has a first side 1611 and a second side 1612. The first side 1611 is spaced from the upper cover 11 by a first distance 1A. A first magnetic body 162 is disposed on an inner circumference of the hub 16.

The shaft rod 17 has a connection end 171 and a protruding end 172. The connection end 171 is connected with the hub 16. The protruding end 172 passes through the shaft hole 143 and protrudes from the second end 142 of the bearing 14 to abut against the closed end 132 of the bearing cup 13 and define a second distance 1B.

The junction between the shaft hole 143 and the first end 141 of the bearing 14 is formed with a first guide angle 1411. The junction between the shaft hole 143 and the second end 142 of the bearing 14 is formed with a second guide angle 1421. The protruding end 172 of the shaft rod 17 is formed with a third guide angle 1721. A distance from a section of the shaft rod 17, where the second guide angle 1421 is positioned to the third guide angle 1721 of the protruding end 172 of the shaft rod 17 is defined as the second distance 1B. The first distance 1A is smaller than the second distance 1B.

Figure 4:
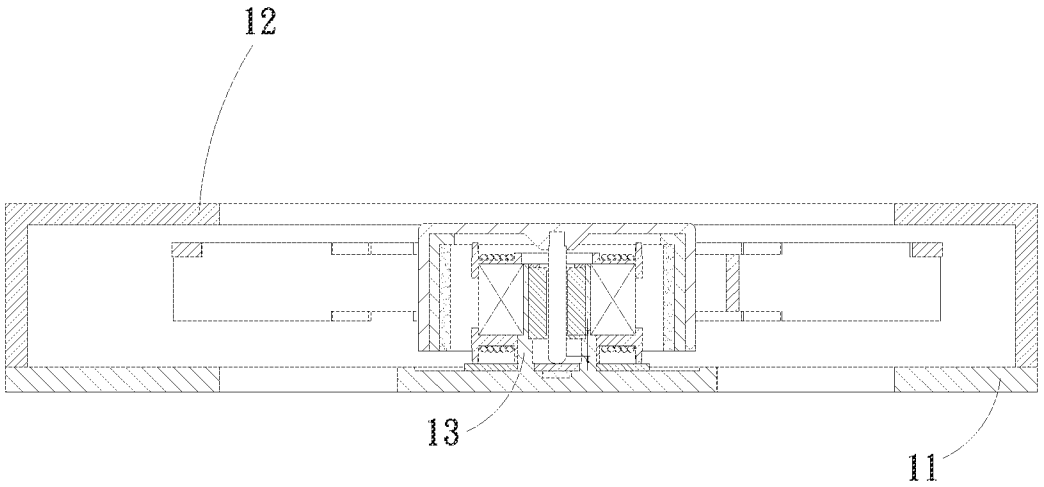
FIG. 4 is a sectional assembled view of a second embodiment of the fan structure of the present invention.

Please now refer to FIG. 4, which is a sectional assembled view of a second embodiment of the fan structure of the present invention. The second embodiment is partially identical to the first embodiment in structure and thus will not be repeatedly described hereinafter. The second embodiment is different from the first embodiment in that the bearing cup 13 is formed on one face of the upper cover 11 and extends from the face of the upper cover 11 to the fan frame body 12.

Figure 5:
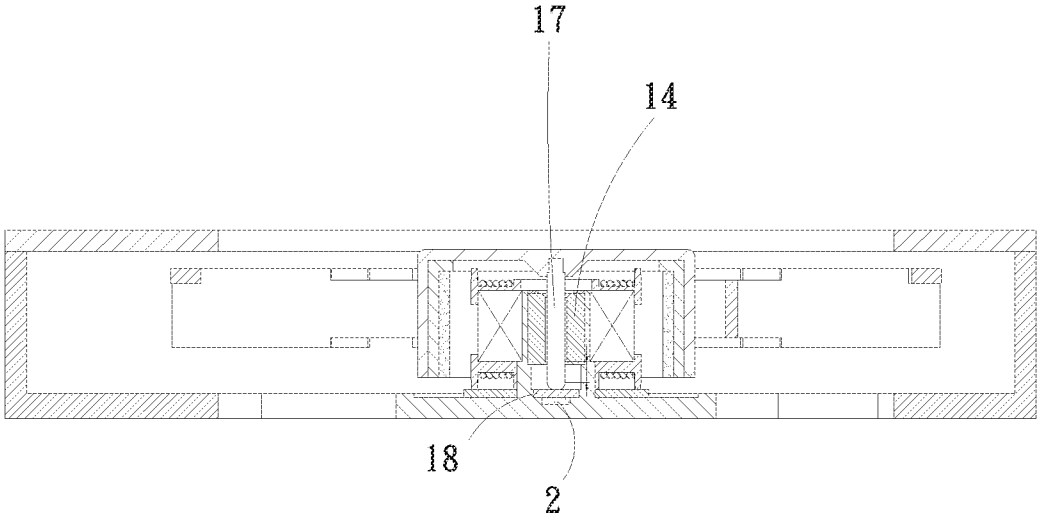
FIG. 5 is a sectional assembled view of a third embodiment of the fan structure of the present invention.

Please now refer to FIG. 5, which is a sectional assembled view of a third embodiment of the fan structure of the present invention. The third embodiment is partially identical to the first embodiment in structure and thus will not be repeatedly described hereinafter. The third embodiment is different from the first embodiment in that a second magnetic body 2 is disposed on one side of the wear plate 18, which side is distal from the shaft rod 17. The second magnetic body 2 is able to apply a magnetic attraction to the hub 16 and the shaft rod 17 connected with the hub 16. In operation of the cooling fan, under the magnetic attraction, the blades 161 are prevented from separating from the fan frame body 12 due to gravity.

The present invention has been described with the above embodiments thereof and it is understood that many changes and modifications in the above embodiments can be carried out without departing from the scope and the spirit of the invention that is intended to be limited only by the appended claims.

What is claimed is:

1. A fan structure comprising:

an upper cover having a first opening;

a fan frame body, the upper cover being correspondingly mated with the fan frame body to together define a receiving space, a wind outlet being formed on one side of the fan frame body;

a bearing cup selectively formed on the upper cover or the fan frame body and protruding from the upper cover or the fan frame body, the bearing cup having an open end and a closed end;

a bearing disposed in the bearing cup, the bearing having a first end, a second end and a shaft hole, the shaft hole passing through the bearing in communication with the first and second ends;

a stator assembly fitted around the bearing cup;

a hub having multiple blades outward extending from the hub, each blade having a first side and a second side, the first side being spaced from the upper cover by a first distance and a ring attached to an outer portion of the first side of the blades; and a shaft rod having a connection end and a protruding end, the connection end being connected with the hub, the protruding end passing through the shaft hole and protruding from the second end of the bearing to abut against the closed end of the bearing cup and define a second distance, the first distance being smaller than the second distance;

wherein a junction between the shaft hole and the first end of the bearing is formed with a first guide angle and a junction between the shaft hole and the second end of the bearing is formed with a second guide angle, the protruding end of the shaft rod being formed with a third guide angle, a distance from a section of the shaft rod, where the second guide angle is positioned to the third guide angle of the protruding end of the shaft rod being defined as the second distance;

wherein a wear plate is disposed at the closed end of the bearing cup; and wherein a second magnetic body is disposed next to one side of the wear plate, said side is distal from the shaft rod.

2. The fan structure as claimed in claim 1, wherein the fan frame body has a bottom wall and multiple ribs, an extension section perpendicularly extending from a periphery of the bottom wall, the wind outlet being formed on one side of the extension section, the upper cover being correspondingly mated with the extension section, two ends of the ribs being respectively connected to the bearing cup and the bottom wall to together define multiple second openings.

3. The fan structure as claimed in claim 1, wherein the stator assembly has multiple silicon steel sheets and multiple windings wound around the silicon steel sheets.

4. The fan structure as claimed in claim 1, wherein a first magnetic body is disposed on an inner circumference of the hub.

* * * * *